US008287109B2

(12) United States Patent
Kitagawa

(10) Patent No.: US 8,287,109 B2
(45) Date of Patent: Oct. 16, 2012

(54) INK HOUSING CONTAINER AND METHOD FOR MANUFACTURING THE SAME

(75) Inventor: Takatoshi Kitagawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 525 days.

(21) Appl. No.: 12/509,295

(22) Filed: Jul. 24, 2009

(65) Prior Publication Data

US 2010/0026774 A1 Feb. 4, 2010

(30) Foreign Application Priority Data

Jul. 31, 2008 (JP) ..... 2008-198851

(51) Int. Cl.
*B41J 2/175* (2006.01)

(52) U.S. Cl. ..... 347/86

(58) Field of Classification Search ..... 347/84–87
See application file for complete search history.

(56) References Cited

U.S. PATENT DOCUMENTS

| | | | | |
|---|---|---|---|---|
| 6,325,500 | B1 * | 12/2001 | Kitabatake et al. | 347/86 |
| 6,416,152 | B1 * | 7/2002 | Matsuzaki et al. | 347/19 |
| 7,527,344 | B2 | 5/2009 | Kitagawa et al. | 347/7 |
| 2006/0099424 | A1 | 5/2006 | Hagiwara et al. | 428/411.1 |
| 2009/0122092 | A1 | 5/2009 | Hatasa et al. | 347/7 |
| 2009/0174736 | A1 | 7/2009 | Kitagawa et al. | 347/7 |

FOREIGN PATENT DOCUMENTS

| | | | |
|---|---|---|---|
| JP | 8-187871 | | 7/1996 |
| JP | 08-187871 | * | 7/1996 |
| JP | 2006-159897 | | 6/2006 |

* cited by examiner

*Primary Examiner* — Geoffrey Mruk
(74) *Attorney, Agent, or Firm* — Fitzpatrick, Cella, Harper & Scinto

(57) ABSTRACT

A present invention provides an ink housing container inhibiting a resin used to form a layer located outside the innermost layer from flowing into a position other than a predetermined one. In an ink tank having an ink container and a cover member, the ink container is formed by a plurality of layers by means of molding. A flow-in preventing portion is formed at a cover member-side end of a side wall of an inner layer one of a plurality of layers forming the ink container. The flow-in preventing portion is formed so as to project from the cover member-side end.

8 Claims, 22 Drawing Sheets

INK HOUSING CONTAINER AND METHOD FOR MANUFACTURING THE SAME

BACKGROUND OF THE INVENTION

1. Field of the Invention

The present invention relates to an ink housing container used for a printing apparatus ejecting a liquid to a print medium for printing.

2. Description of the Related Art

In recent years, ink jet printing apparatuses have been prevailing rapidly in which a print head ejects ink droplets to a print medium for printing. These ink jet printing apparatuses have the advantages of allowing the sizes thereof to be easily reduced and being capable of relatively easily performing color printing.

Some of these ink jet printing apparatuses include an ink tank serving as an ink housing container and from which ink is fed to the print head, which ejects ink to the print medium. With the ink jet printing apparatuses prevailing, the usage and production of ink tanks used for the ink jet printing apparatus have been increasing year by year. Many of such ink tanks are manufactured by filling resin into a mold tool for injection molding to form the resin into a predetermined shape and are adopted.

As described above, the ink tank in which ink is stored is often made of resin, generally. The resin used for the ink tank requires a high mechanical strength, a high chemical resistance, and an excellent gas barrier property. Thus, a recycled resin has not been used many times and a virgin resin has often been used to manufacture ink tanks.

However, much effort has been made to develop universal design throughout the world. Based on the concept of the universal design, industrial products are manufactured with visibility and ease of use taken into account. Thus, the design of products with user friendliness taken into account has been more important. Based on the concept of the universal design, some ink tanks are formed such that an outer layer of the ink tank composed of multiple layers is partly colored in the same color as that of the ink housed in the ink tank, and such ink tanks are adopted. Such a type of ink tank is formed of, besides the virgin resin, a resin colored in the same color as that of the ink. The ink tank thus formed serves to improve the visibility of the color of the ink inside the ink tank, allowing the user to easily determine the color of the ink housed inside the ink tank. Thus, at present, many ink tanks are composed of a plurality of layers including a layer formed of the virgin resin and a colored layer.

Furthermore, much attention has recently been paid to makers' approaches to environmental problems. Thus, for the manufacture of ink tanks, various attempts have been made to manufacture products taking the environmental problems into account. As part of approaches to the environmental problems, efforts have been made to develop a closed recycling involving the production, sale, collection, and reutilization of products. This allows the materials of the products to be reutilized. As described above, the ink tank may be molded using a recycled resin so that the resin forms a part of the ink tank.

In connection with an environmentally friendly ink tank, Japanese Patent Laid-Open No. 2006-159097 discloses a method for molding an ink tank using a recycled resin. The method for molding the ink tank disclosed in Japanese Patent Laid-Open No. 2006-159897 uses a multilayer injection compression molding method to form at least one layer of a molding target member using the recycled resin.

Japanese Patent Laid-Open No. H8-187871 (1996) discloses an ink tank including an outer wall partly formed of a recycled resin. In the ink tank disclosed in Japanese Patent Laid-Open No. H8-187871 (1996), a portion of the ink tank contacting with the internally stored ink is formed of an unused, virgin resin. The outer wall portion not contacting with the ink is formed of the recycled resin. The ink tank formed partly of the recycled resin is manufactured while maintaining resistance to ink.

The ink tank manufacturing process described above requires consideration for the adverse effect, on the quality of the ink, of the contact of the ink with the ink tank, causing the resin component of the ink tank to be eluted into the ink. When the ink is stored inside the ink tank formed of a resin failing to resist ink, the resin component may be eluted into the stored ink. This may change the components of the ink.

Furthermore, if the resin forming the ink tank offers an inadequate gas barrier property, air entering the ink tank may change the components of the ink. The thus changed characteristics of the ink may degrade the quality of the ink.

Thus, a portion of the ink tank in which the ink is stored needs to be formed of a material that resists ink and prevents air from entering the ink tank. Thus, when an ink tank is formed using both an unused, virgin resin and a colored or recycled resin, the portion of the ink tank in which the ink is stored needs to be formed of the virgin resin. A portion of the ink tank which does not contact with the ink may be formed of the colored or recycled resin.

An example of the conventional ink tank manufacturing process disclosed in Japanese Patent Laid-Open Nos. 2006-159097 and H8-187871 (1996), described above, will be described with reference to FIGS. 19 to 22A and 22B. As shown in FIG. 19, an ink tank 101 as an ink housing container has a cover member 111 and an ink container 120 as a container member. The ink container has two resin layers, an inner layer 121 and an outer layer 122.

FIG. 19 is a sectional view of the conventional ink tank. Ink is stored in the inner layer 121 of the ink container 120, formed of the two layers. Thus, the inner layer 121 is formed of a material that resists ink and prevents air from entering the ink tank. The outer layer 122, covering the outer periphery of the inner layer 121, is formed outside the inner layer 121.

FIG. 20A shows a primary molding step of the manufacturing process for the ink container 120 of the ink tank 101 shown in FIG. 19. Here, the primary molding is a step of forming the inner layer 121 of the ink container 320 by means of molding. In the primary molding, a movable mold 160 and a first fixed mold 161 are used as a mold tool for molding the ink container 120. As shown in FIG. 20A, a first resin 21-*a* is infected between the movable mold 160 and the first fixed mold 161 by an injection cylinder 163. At this time, a clamping force is held between the movable mold 160 and the first fixed mold 161. Thus, the first resin 21-*a* is filled under pressure. Then, the mold tool is cooled with the pressure maintained to solidify the first resin 21-*a*. The inner resin 121 is thus formed.

FIG. 20B is a sectional view of the end of a side wall portion of the inner layer of the ink container 120 formed by the primary molding. As shown in FIG. 20B, a side surface is formed on a side wall of the inner layer 121 so as to extend substantially perpendicularly from a surface of the cover member-side end thereof which surface contacts with the cover.

The step shown in FIG. 21A is carried out between the primary molding and secondary molding described below. With the inner layer 121 formed by the primary molding attached to the movable mold 160 without being separated therefrom, the movable mold 160 moves to a position corresponding to a second fixed mold 162. Thus, the mold located at the position corresponding to the movable mold 160 changes from the first fixed mold 161 to the second fixed mold 162. At this timer a space is provided between the inner layer 121 and the second fixed mold 162 so that a resin forming the outer layer described below is positioned in the space. In this case, while the first molding step is shifting to the secondary step, the inner layer 121 is cooled and shrunk in the directions of arrows shown in FIG. 21A.

FIG. 21A, the lengths of the arrows correspond to the amounts of shrinkage. The shrinkage amount of the resin is proportional to the thickness of the molded resin. Thus, in the ink container in this example shaped as described above, the side wall 125 shrinks more significantly in the height direction from the bottom surface of the ink container 120 than in the thickness direction of the side wall 125. In this case, for the shrinkage of the side wall 125 in the height direction thereof, the amount of change corresponding to the shrinkage is manifested at the end of the side wall 125 because the bottom surface 124 is in contact with the movable mold 160. FIG. 21B shows the end of the inner layer 121 in this case. As described above, the shrinkage of the inner layer 121 results in a gap 165 between the movable mold 160 and an ink container-side coupling portion 123 that is a surface of the inner layer contacting with the cover member 110.

When the movable mold moves from the position corresponding to the first fixed mold 161 to a position corresponding to the second fixed mold 162, secondary molding is performed by injecting a second resin 22-*a* used to form an outer layer, into the space between the inner layer 121 and the second fixed mold 162, as shown in FIG. 22A.

At this time, the resin may flow into the gap 165, which is present between the inner layer and the movable mold and which has been formed between the primary molding and the secondary molding by the shrinkage of the inner layer 121 resulting from the solidification thereof. FIG. 22B is a sectional view of the end of the ink container formed by the resin flowing into the gap 165. The resin used for the primary molding is assumed to be used for the inner layer, which contacts with the ink. The resin is thus secured ink resistance and a gas barrier property. The resin is further secured a proper bonding strength with respect to the cover member 110. However, the resin used for the secondary molding is used to form the outer layer 122 and may thus fail to secure a proper bonding strength and sufficient closeness. Consequently, when the resin filled during the secondary molding flows into the gap 165, the resin for the secondary molding is present between the cover member 110 and the ink container 120. This may prevent a portion requiring a high bonding strength and high closeness from offering these properties.

Furthermore, in FIGS. 22A and 22B, the second resin 22-*a* is filled up to the inner end of the gap between the movable mold 160 and the inner layer 121. However, since the gap is a relatively narrow area, when the second resin 22-*a* flows through the gap, a relatively large flow resistance occurs in the second resin 22-*a*. Thus, even when the second resin 22-*a* is filled between the movable mold 160 and the second fixed mold 162 under pressures the second resin 22-*a* may stop flowing before reaching the inner end of the gap. In this case, the resin may not be in part of the gap to form a recess and a protrusion in an area in which the ink container 120 and the cover member 110 are in contact. This may make the coupling area between the ink container 120 and the cover member 110 insufficient. Consequently, the coupling portion may fail to offer a sufficient strength. Furthermore, the recess and protrusion in the area in which the ink container 120 and the cover member 110 are in contact may prevent high closeness from being maintained between the ink container 120 and the cover member 110.

As described above, in the conventional ink tank 101, the cover member 110 and the member forming the ink container 120 of the ink tank 101 may be improperly coupled together or insufficiently closed. Moreover, if a recycled resin is used to form the outer layer 122, the recycled resin may flow to the inner layer side of the ink container 120 and come into contact with the stored ink. Then, the resin may be eluted, thus changing the characteristics of the ink stored inside the ink tank. A similar problem may occur with the cover member 110, which is a component of the ink tank 101 other than the ink container 120, if the second resin flows to the inner side.

SUMMARY OF THE INVENTION

In view of the above-described circumstances, an object of the present invention is to provide an ink housing container preventing a resin forming a layer located outside the innermost layer from flowing into a position other than a predetermined one.

According to a first aspect of the present invention, there is provided an ink housing container housing ink, the ink housing container comprising: a cover member formed of a first resin; a container member having an inner layer formed of the first resin and contacting with the housed ink and an outer layer formed of a second resin different from the first resin, the inner layer being configured such that a part of a cover member-side end of the inner layer projects.

According to a second aspect of the present invention, there is provided an ink housing container housing ink, the ink housing container comprising: a cover member formed of a first resin; a container member having an inner layer formed of the first resin and contacting with the housed ink and an outer layer formed of a second resin different from the first resin, the inner layer being configured such that a portion of the inner layer bonded to the cover member projects toward the outer layer side.

According to a third aspect of the present invention, there is provided a method for manufacturing an ink housing container having a container member and a cover member and in which ink is accommodated, the container member being formed by a plurality of layers by means of molding, the container member being formed using at least one common mold commonly used to form both an inner layer contacting with the housed ink and a layer located outside the inner layer, the method comprising: a primary molding step of filling a first resin between the common mold and a first mold enabling a side wall of the inner layer to be formed such that a part of a cover member-side end of the side wall projects, and forming the inner layer; and a secondary molding step of filling a second resin between the common mold and a second mold, and forming the layer located outside the inner layer.

The present invention provides the ink housing container preventing the resin forming the layer of the container member located outside the innermost layer thereof from flowing into the position of the innermost layer. Furthermore, the surface of the coupling portion between the container member and the cover member is kept smooth. This ensures a proper coupling area and a high bonding strength between the container member and the cover member.

Further features of the present invention will become apparent from the following description of exemplary embodiments (with reference to the attached drawings).

BRIEF DESCRIPTION OF TEE DRAWINGS

FIG. 1A to 1C are sectional views of an ink tank according to a first embodiment of the present invention, wherein FIG.

1A is a sectional view of the ink tank as a whole, FIG. 1B is an enlarged sectional view of a cover member-side end of a side wall of an ink container of the ink tank, and FIG. 1C is an enlarged sectional view of a coupling portion between the ink container and the cover member;

FIGS. 3A and 3B are diagrams illustrating a primary molding step of the process of manufacturing the ink tank in FIG. 1A, wherein FIG. 3A is a sectional view of a mold tool and an inner layer as a whole, and FIG. 3B is an enlarged sectional view of the cover member-side end of the inner layer;

FIGS. 4A and 4B are diagrams illustrating the condition of the ink tank between the primary molding and secondary molding during the process of manufacturing the ink tank in FIG. 1A, wherein FIG. 4A is a sectional view of the mold tool and inner layer as a whole, and FIG. 4B is an enlarged sectional view of the cover member-side end of the inner layer;

FIGS. 5A and 5B are diagrams illustrating the secondary molding step of the process of manufacturing the ink tank in FIG. 1A, wherein FIG. 5A is a sectional view off the mold tool, the inner layer, and an outer layer as a whole, and FIG. 5B is an enlarged sectional view of the cover member-side ends of the inner layer and the outer layer;

Figure 6A:
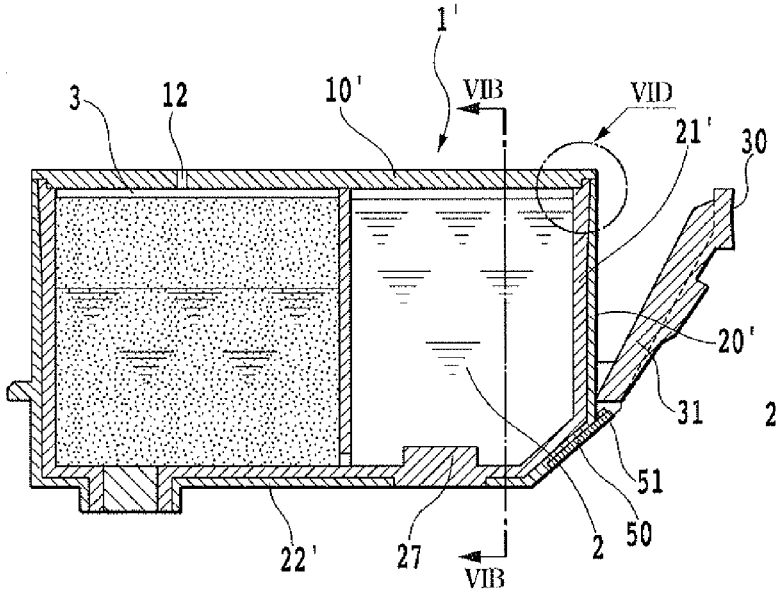
Figure 6B:
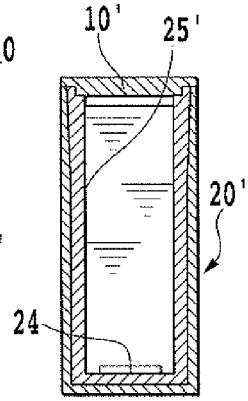
Figure 6C:
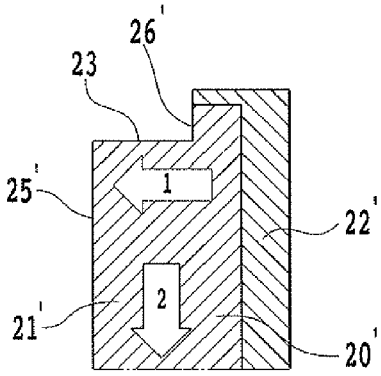
Figure 6D:
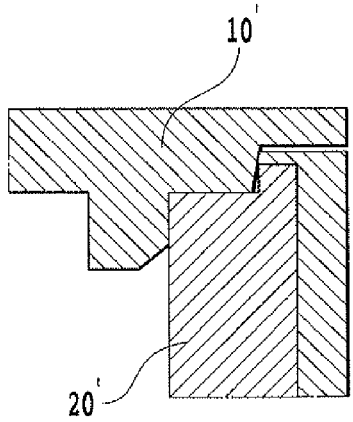
Figure 7A:
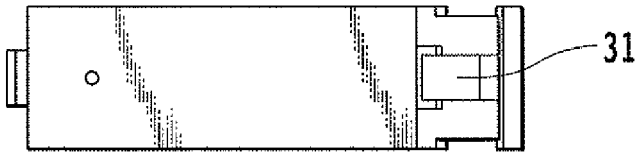
Figure 7B:
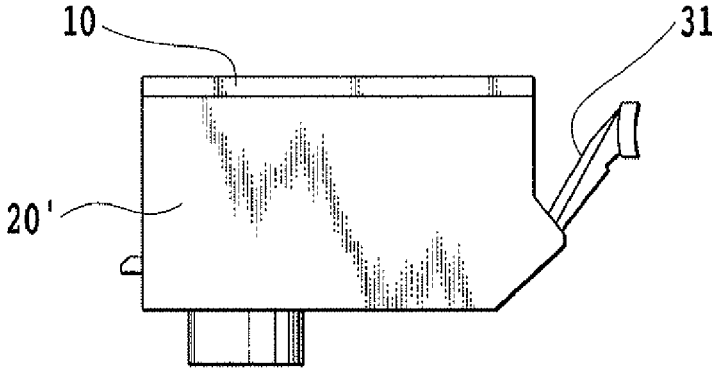
Figure 7D:
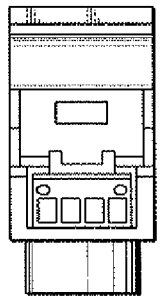
Figure 7C:
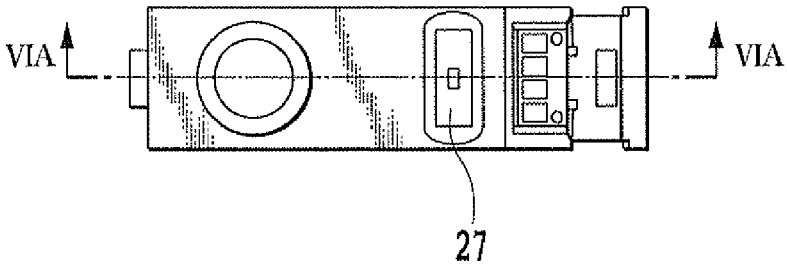
Figure 9A:
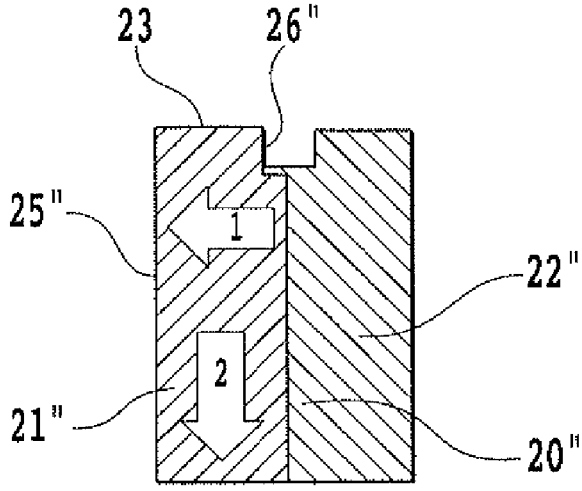
Figure 9B:
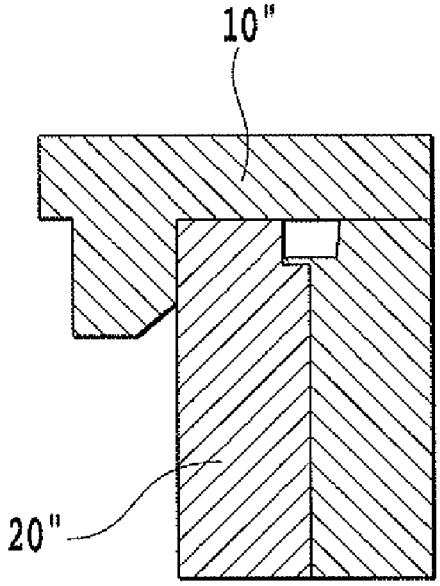
Figure 11A:
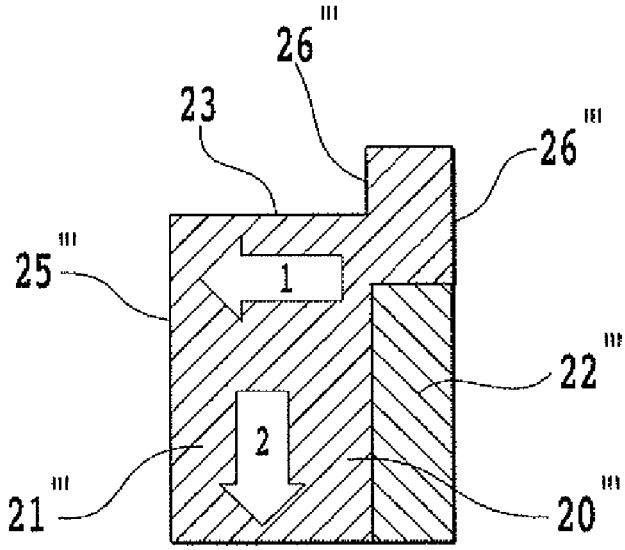
Figure 11B:
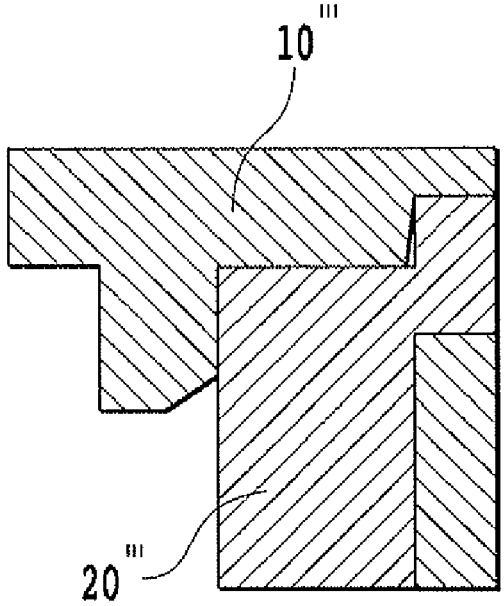
Figure 13:
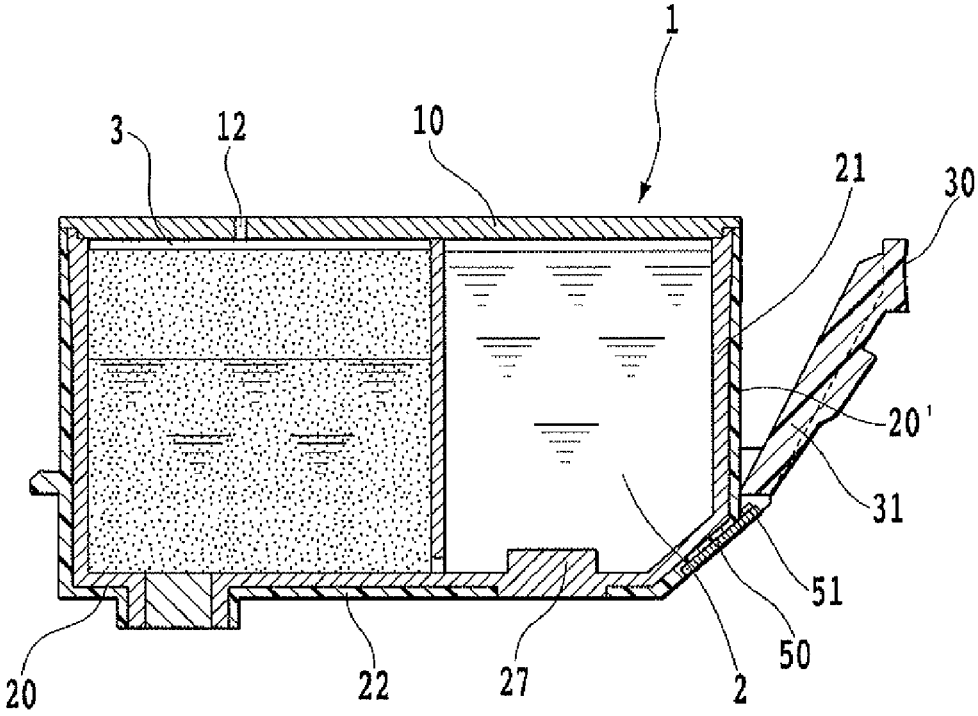
Figure 14A:
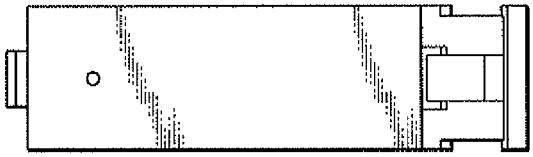
Figure 14B:
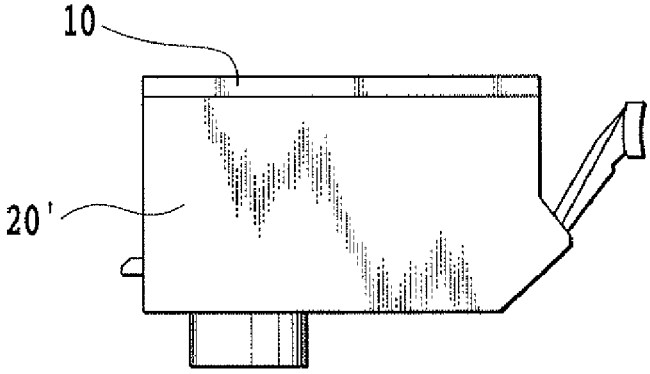
Figure 14D:
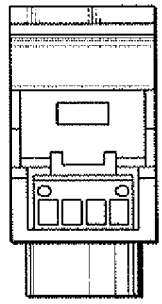
Figure 14C:
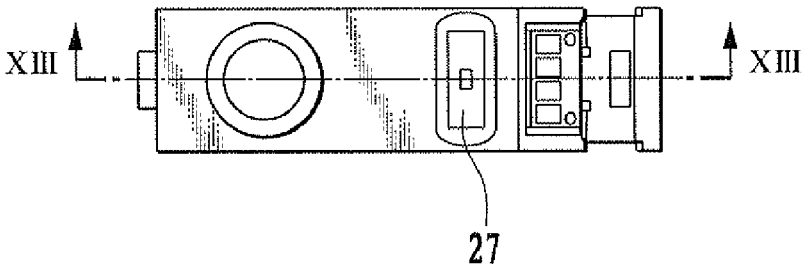
Figure 15:
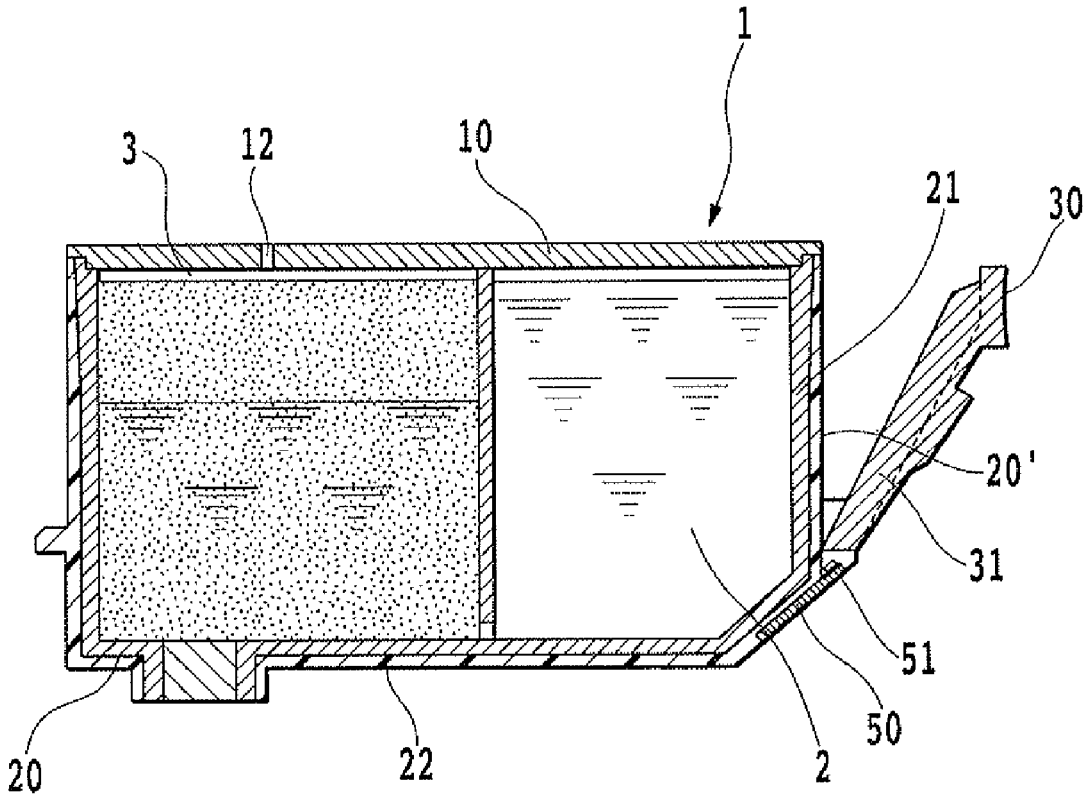
Figure 16A:
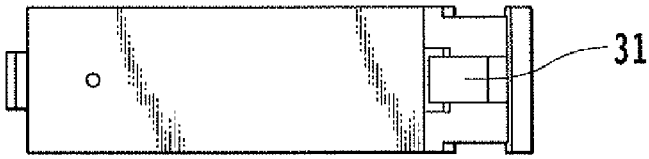
Figure 16B:
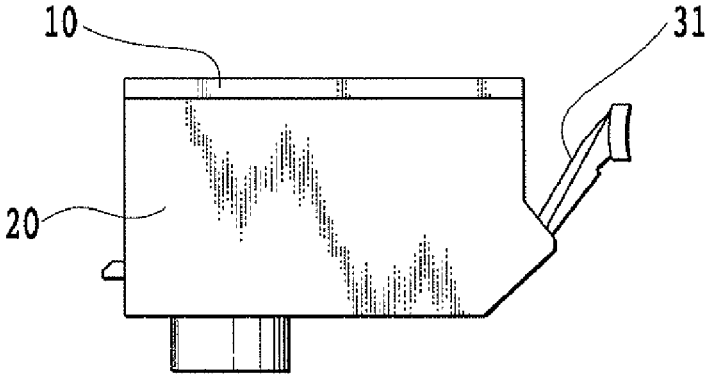
Figure 16D:
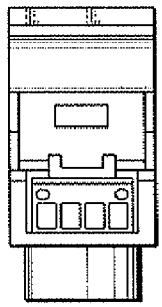
Figure 16C:
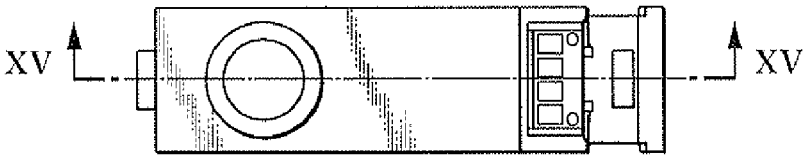
Figure 17:
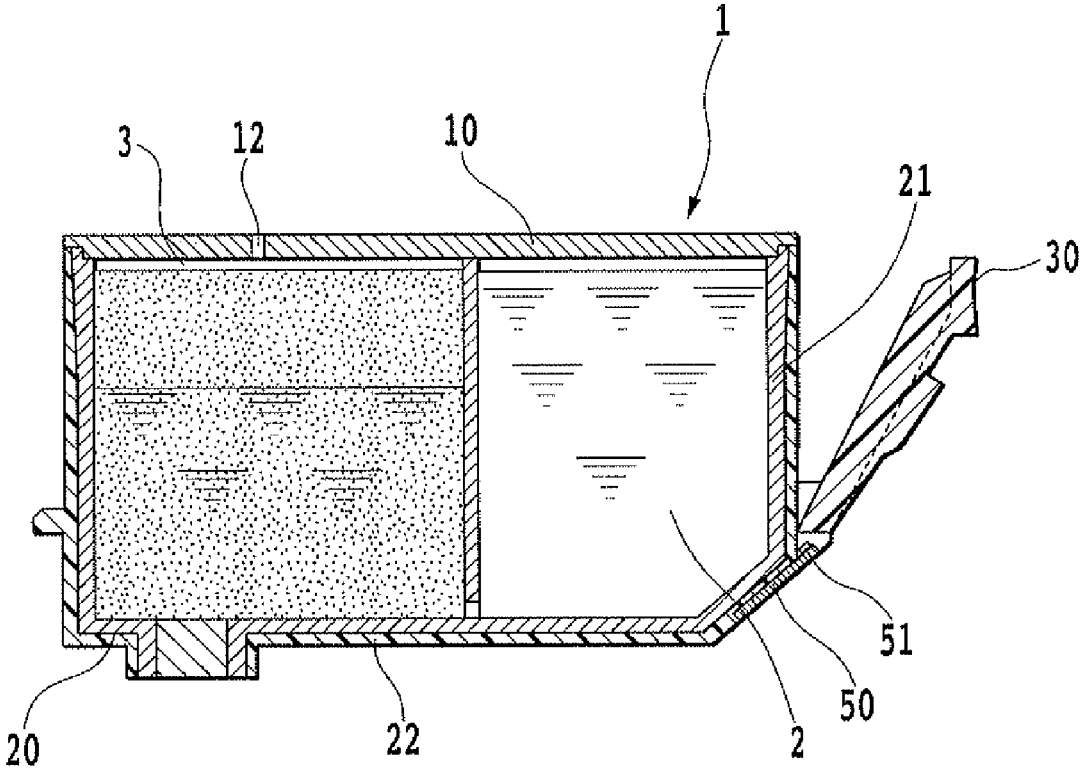
Figure 18A:
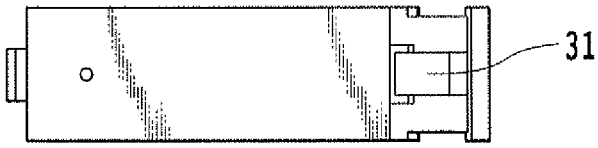
Figure 18B:
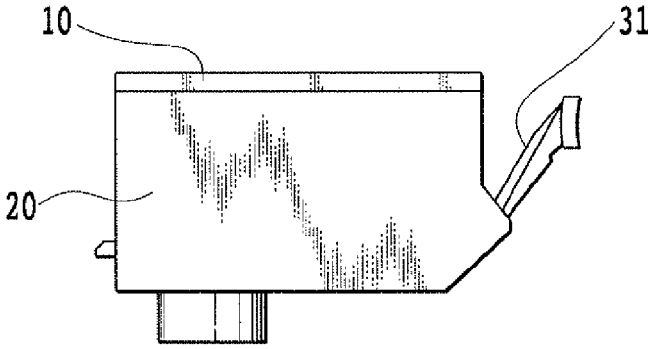
Figure 18D:
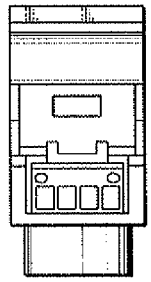
Figure 18C:
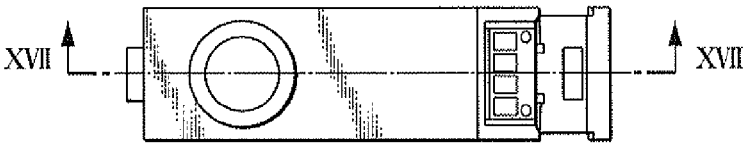
Figure 19:
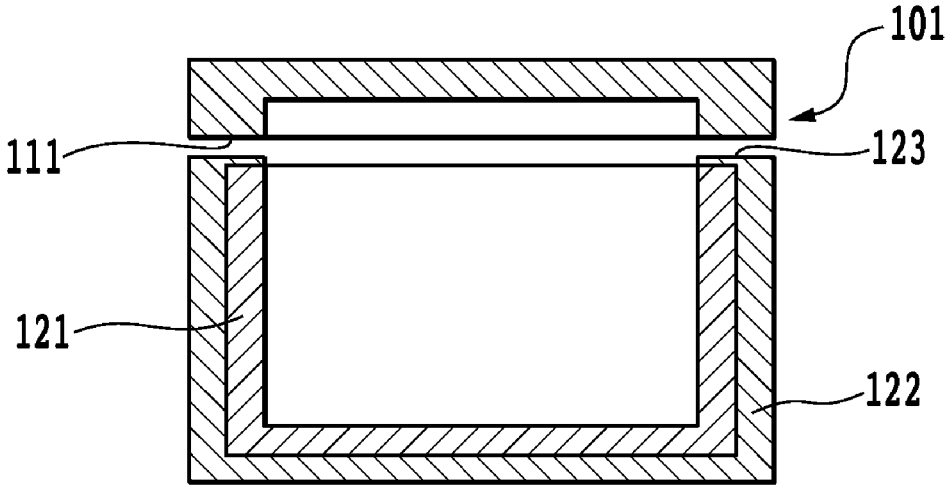
FIG.19 (PRIOR ART)
Figure 20A:
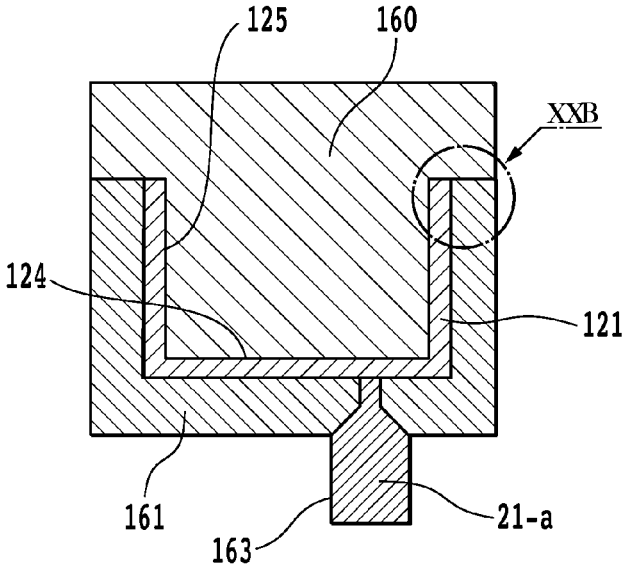
FIG.20A (PRIOR ART)
Figure 20B:
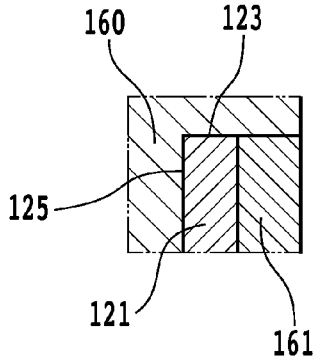
FIG.20B (PRIOR ART)
Figure 21A:
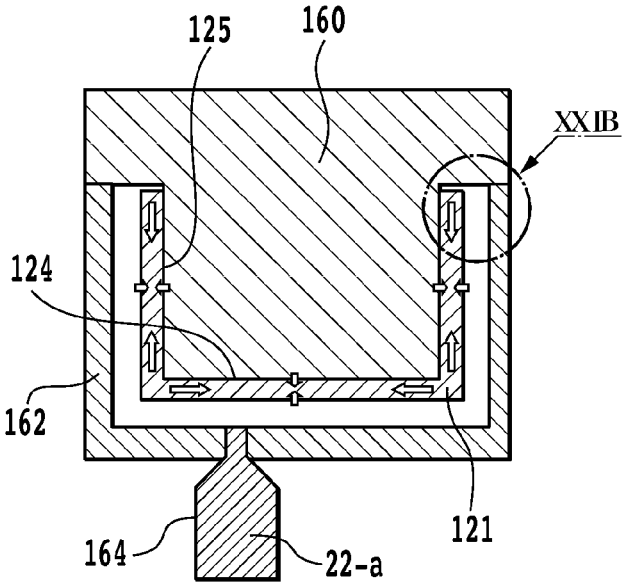
FIG.21A (PRIOR ART)
Figure 21B:
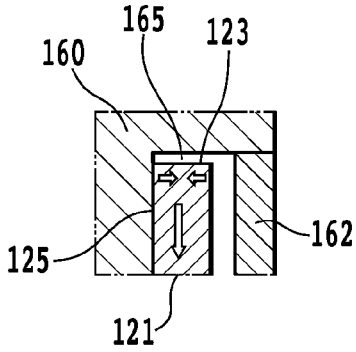
FIG.21B (PRIOR ART)
Figure 22A:
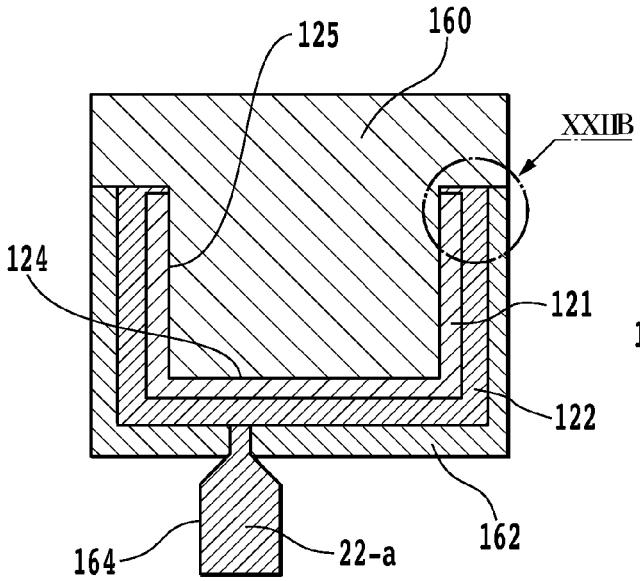
FIG.22A (PRIOR ART)
Figure 22B:
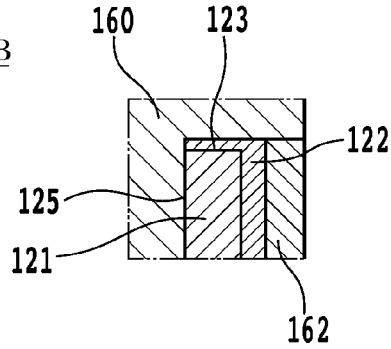
FIG.22B (PRIOR ART)

FIGS. 6A to 6D are sectional views of an ink tank according to a second embodiment of the present invention, wherein FIG. 6A is a sectional view of the ink tank as a whole, FIG. 6B is a sectional view taken along line VIB-VIB in FIG. 6A, FIG. 6C is an enlarged sectional view of a cover member-side end of a side wall, and FIG. 6D is an enlarged sectional view of the coupling portion between an ink container and the cover member;

FIGS. 7A to 7D show the appearance of the ink tank in FIG. 6A, wherein FIG. 7A is a plan view as viewed from above, FIG. 7B is a side view, FIG. 7C is a plan view as viewed from below, and FIG. 7D is a front view;

FIGS. 8A to 8D are diagrams illustrating a process of manufacturing the ink container of the ink tank in FIG. 6A;

FIGS. 9A and 9B are sectional views of an ink tank according to another embodiment, wherein FIG. 9A is an enlarged sectional view of a cover member-side end of a side wall, and FIG. 9B is an enlarged sectional view of a coupling portion between an ink container and the cover member;

FIGS. 10A to 10D are diagrams illustrating a process of manufacturing the ink container of the ink tank in FIGS. 9A and 9B;

FIGS. 11A and 11B are sectional views of an ink tank according to yet another embodiment, wherein FIG. 11A is an enlarged sectional view of a cover member-side end of a side wall, and FIG. 11B is an enlarged sectional view of a coupling portion between an ink container and the cover member;

FIGS. 12A to 12D are diagrams illustrating a process of manufacturing the ink container off the ink tank in FIGS. 11A and 11B;

FIG. 13 is a sectional view of an ink tank according to still another embodiment;

FIGS. 14A to 14D are a plan view of the ink tank in FIG. 13 as viewed from above, a side view of the ink tank in FIG. 13, a plan view of the ink tank in FIG. 13 as viewed from below, and a front view of the ink tank in FIG. 13;

FIG. 15 is a sectional view of an ink tank according to further another embodiment;

FIGS. 16A to 16D are a plan view of the ink tank in FIG. 15 as viewed from above, a side view of the ink tank in FIG. 15, a plan view of the ink tank in FIG. 15 as viewed from below, and a front view of the ink tank in FIG. 15;

FIG. 17 is a sectional view of an ink tank according to further another embodiment;

FIGS. 18A to 18D are a plan view of the ink tank in FIG. 17 as viewed from above, a side view of the ink tank in FIG. 17, a plan view of the ink tank in FIG. 17 as viewed from below, and a front view of the ink tank in FIG. 17;

FIG. 19 is a sectional view showing an example of a conventional ink tank;

FIGS. 20A and 20B are diagrams illustrating a primary molding step of a process of manufacturing the ink tank in FIG. 19, wherein FIG. 20A is a sectional view of a mold tool and an inner layer as a whole, and FIG. 20B is an enlarged sectional view of the cover member-side end of the inner layer;

FIGS. 21A and 21B are diagrams illustrating the condition of the ink tank between the primary molding and secondary molding during the process of manufacturing the ink tank in FIG. 19, wherein FIG. 21A is a sectional view of the mold tool and inner layer as a whole, and FIG. 21B is an enlarged sectional view of the cover member-side end of the inner layer; and FIGS. 22A and 22B are diagrams illustrating the secondary molding step of the process of manufacturing the ink tank in FIG. 19, wherein FIG. 22A is a sectional view of the mold tool, the inner layer, and an outer layer as a whole, and FIG. 22B is an enlarged sectional view of the cover member-side ends of the inner layer and the outer layer.

DESCRIPTION OF THE EMBODIMENTS

Embodiments in which the present invention is implemented will be described below with reference to the drawings.

First Embodiment

Figure 1A:
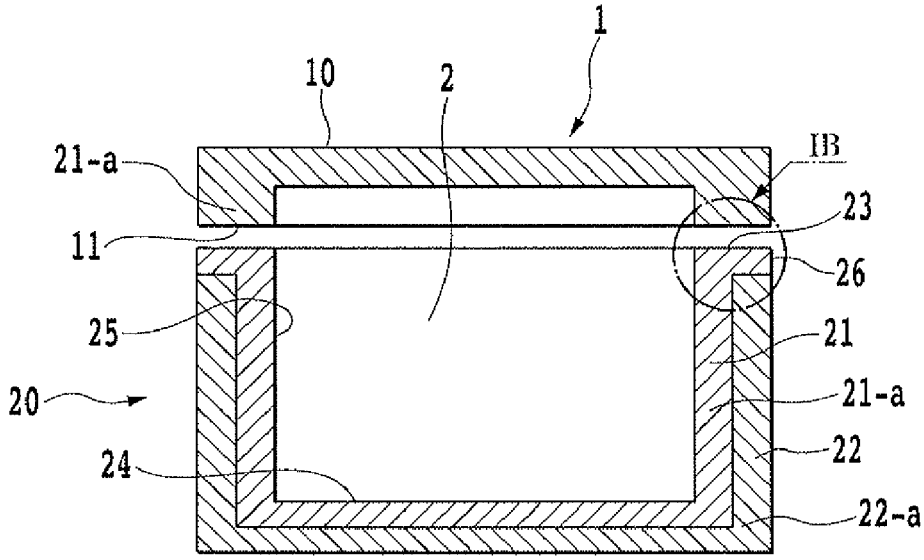
Figure 1B:
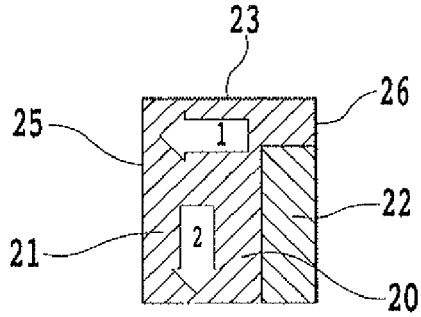
Figure 1C:
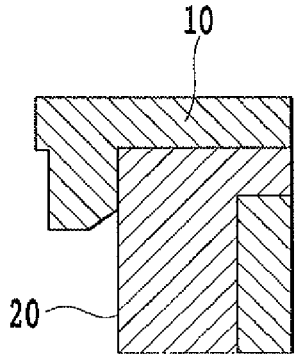
Figure 2:
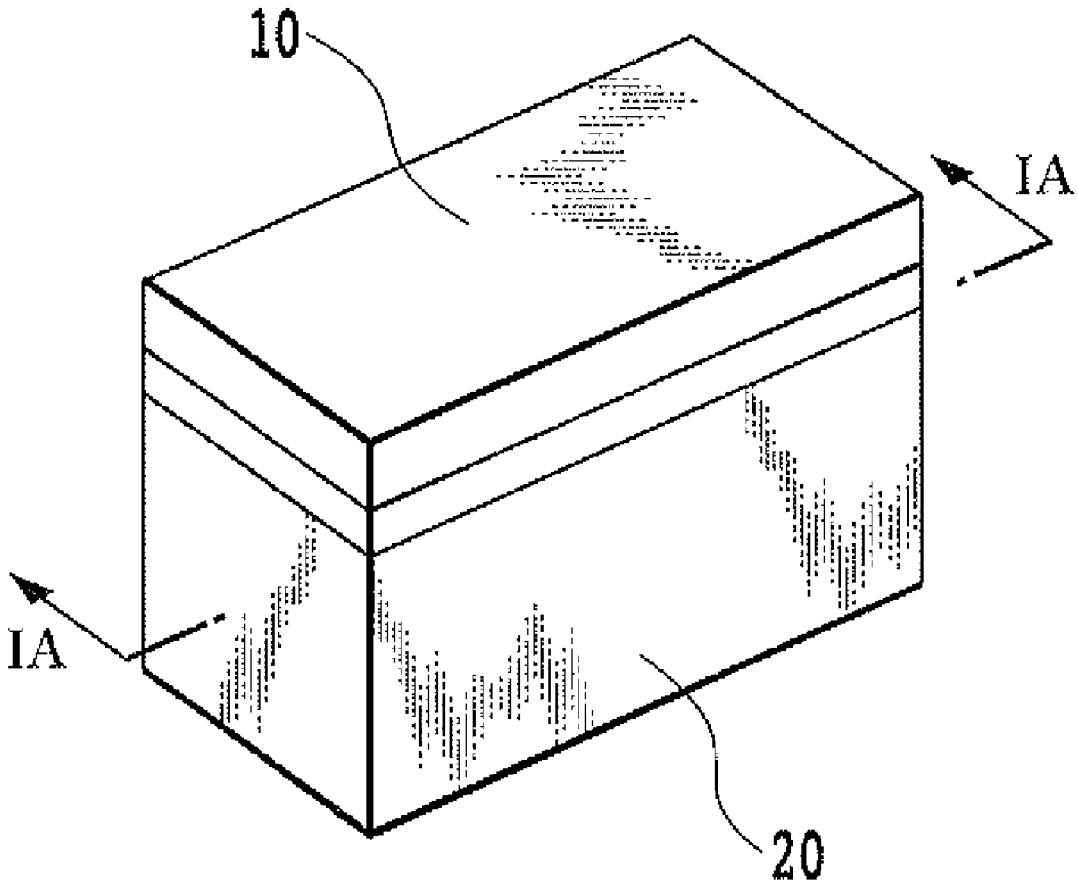
FIG. 2 is a perspective view of the ink tank in FIG. 1A.

FIGS. 1A to 1C and FIG. 2 show an fink tank 1 as an ink housing container according to a first embodiment of the present invention. The ink tank 1 according to the present embodiment can be mounted in the ink jet printing apparatus. Ink as a liquid stored in the ink tank 1 is supplied to a print head (not shown in the drawings), which ejects the ink to a print medium. FIG. 2 is a perspective view of the ink tank 1. FIG. 1A is a sectional view taken along line IA-IA in FIG. 2. FIG. 1B is an enlarged sectional view of a cover member-side end of an ink container of the ink tank according to the present embodiment. FIG. 1C is an enlarged sectional view of a coupling portion of the ink tank according to the present embodiment between the ink container and cover member coupled together.

In FIGS. 1A to 1C and 2, the ink tank 1 has a cover member 10 and an ink container 20 as a container member. When the cover member 10 and the ink container 20 are coupled together, a liquid housing chamber 2 in which ink is accommodated is defined inside the ink tank 1. The ink container 20 is formed of multiple layers by molding; the plurality of layers are stacked. In the present embodiment, in particular, the ink container 20 is formed of an inner layer 21 and an outer layer 22. An inner layer 21, one of the two layers forming the ink container 20 and contacting ink, is formed of a first resin 21-*a*. An outer layer 22 not contacting the ink is formed of a second resin 22-*a*. The first resin 21-*a* is an unused, virgin resin. The first resin 21-*a* resists ink to prevent components of the resin from being eluted even when the resin contacts with the ink. The first resin 21-*a* is known to be used for the inner layer 21 of the ink container 20. Thus, the first resin 21-*a* needs to be predetermined to be applicable, in connection with ink resistance and a gas barrier property, to an environment in which the resin is used as the inner layer. In this case, the first resin has a relatively high transparency equal to or higher than that of the second resin. A colored resin, a recycled resin, or the like may be used as the second resin 22-*a*. If the recycled resin is used as the second resin, a reutilized material containing a recycled material previously used is used as the second resin 22-*a*. The ink container 20 has a bottom surface 24 and a side wall 25 extending substantially perpendicularly to the bottom surface 24. The inner layer 21 of the ink container 20 has an ink container-side coupling portion 23 serving as a coupling portion at an end of the side wall 25 between the cover member 10 and the ink container 20. In the present embodiment, a flow-in preventing portion 26 (projecting portion) extending outward from the outermost portion of the whole side wall 25 of the inner layer 21 except for the cover member-side end thereof is formed at the end of the side wall 25 contacting with the cover member 10. Like the inner layer 21, the flow-in preventing portion 26 is formed of the first resin 21-*a*. In the ink tank 1 according to the present embodiment, the cover-side end of the side wall 25 of the ink container is shaped as shown in FIG. 1B.

The cover member 10 has a cover-side coupling portion 11 coupled to the ink container-side coupling portion 23. The cover-side coupling portion 11 is formed of the same first resin 21-*a* as that forming the ink container-side coupling portion 23.

A method for manufacturing the ink tank 1 shown in FIGS. 1A to 1C and FIG. 2 will be described with reference to FIGS. 3A to 5B. FIGS. 3A to 5B are sectional views of the ink container 20 of the ink tank 1 and a mold tool used to manufacture the ink container 20 by molding, in connection with the method for manufacturing the ink tank 1 according to the first embodiment, as well as corresponding enlarged sectional views of the end of the ink container 20.

Figure 3A:
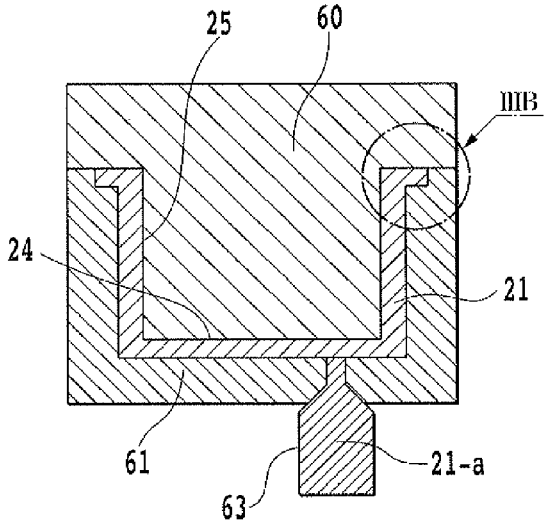
Figure 3B:
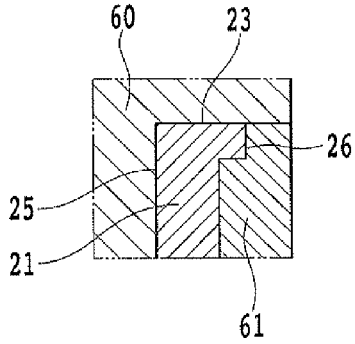

FIG. 3A shows a primary molding step in which the inner layer 21 the innermost one of the plurality of layers making up the ink container of the ink tank 1 formed of the multiple layers by molding is formed by molding. The primary molding as used herein refers to a step of forming the inner layer 21 of the ink container 20 by molding. FIG. 3B is a corresponding enlarged sectional view of the cover member-side end of the side wall 25 of the ink container 20.

As shown in FIG. 3A, the first resin 21-*a*, used to form the inner layer 21, is filled into a mold tool including a movable mold 60 (common mold) and a first fixed mold 61 (first mold). The first resin 21-*a* is injected and filled between the movable mold 60 and the first fixed mold 61 by an injection cylinder 63. Then, with the first resin 21-*a* between the movable mold 60 and the first fixed mold 61 under pressure, the molds are closed for molding. During the molding, the first resin 21-*a* continues to be pressurized by the clamping force of the mold tool; the pressure applied to the first resin 21-*a* is held. Here, the first fixed mold 61 enables the flow-in preventing portion to be formed at the cover member-side end on the side wall 25 of the inner wall 21. The first resin is filled between the movable mold 60 and the first fixed mold 61 to form the inner layer 21 with the flow-in preventing portion formed at the cover member-side end of the side wall 25. Thereafter, the mold tool with the first resin 21-*a* filled therein is cooled to solidify the first resin 21-*a*. The molding of the inner layer 21 is finished.

Figure 4A:
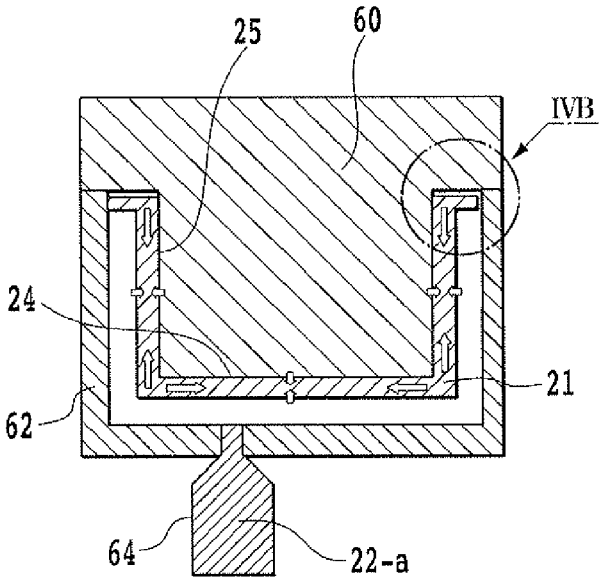
Figure 4B:
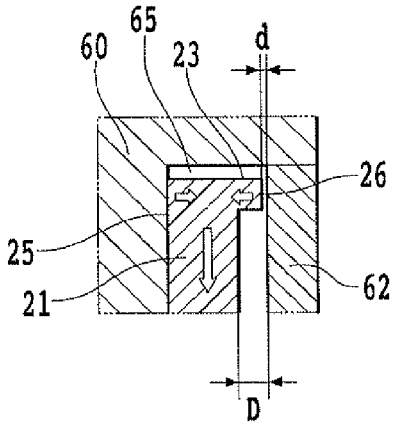

FIG. 4A is a sectional view of the mold tool and the inner layer 21 wherein after the primary molding is finished, for secondary molding, the movable mold is moved and placed at a position corresponding to the fixed mold used for the secondary molding. At this time, the inner layer 21 formed by the primary molding shrinks in the directions of arrows in FIG. 4A. FIG. 4B is an enlarged sectional view of the cover member-side end of the side wall 25 of the inner layer 21.

A step of the manufacturing process for the ink container 20 shown in FIGS. 4A and 4B is carried out between the primary molding and the secondary molding. FIG. 4A shows the inner layer 21 of the ink container 20 placed inside the mold made up of the movable mold 60, used to mold the bottom surface 24 and side wall 25 of the liquid accommodating chamber 2, and a second fixed mold 62 (second mold) used to mold the outer layer 22. FIG. 4A shows that the movable mold 60 has been moved from the position corresponding to the first fixed mold 61, used for the primary molding, to the position corresponding to the second fixed mold 62, used for the secondary molding. During the movement of the movable mold 60 from the first fixed mold 61 to the second fixed mold 62, the inner layer 21 formed by the primary molding shrinks in the directions of arrows shown in FIG. 4B.

Figure 5A:
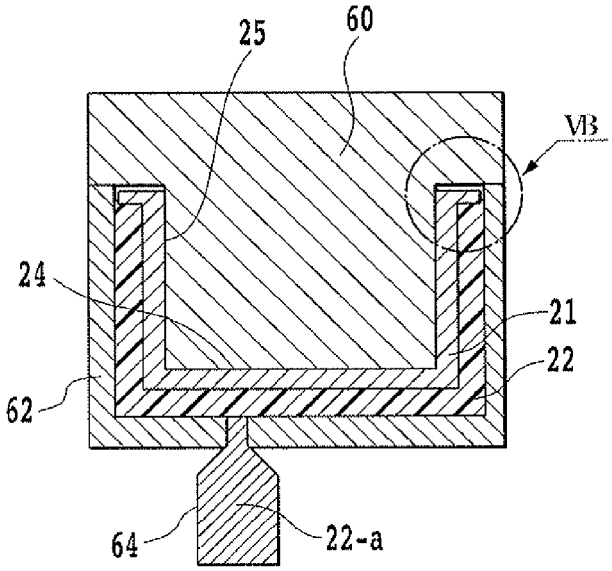
Figure 5B:
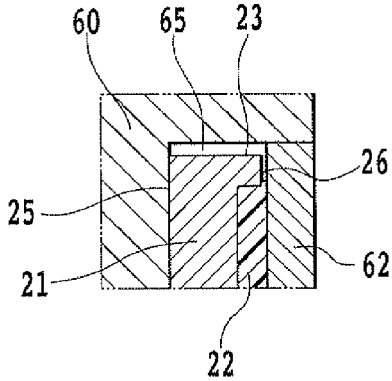

Thereafter, as shown in FIG. 5A, the outer layer 22 of the ink container 20 is formed by the secondary molding. FIG. 5B is an enlarged sectional view of the cover member-side end of the side wall 25 during the secondary molding. In the present embodiment, the secondary molding refers to a step of molding a resin outside the inner layer 21 in order to form the outer layer 22 after the primary molding. In the secondary molding, the outer layer 22 is formed by injecting a second resin 22-*a* between the second fixed mold 62 and the inner layer 21 formed by the primary molding.

After the primary molding, the resin is cooled and thus shrunk. The shrinkage amount of the resin is proportional to the thickness of the molded resin. The magnitude relation among the lengths of the arrows shown in FIGS. 4A and 4B corresponds to that among the amounts of shrinkage. The shrinkage amount is relatively large in the direction from the bottom surface 24 of the ink container 20 toward the cover member because of the relatively large length of the resin portion in this direction. In this case, since the bottom surface 24 of the inner layer is in contact with the movable mold 60, when the side wall 25 of the ink container shrinks, this displacement is appeared at the cover-side end of the side wall 25. Thus, the cover-side end of the side wall 25 of the ink container 20 moves toward the bottom surface to create a gap between the ink container-side coupling portion 23 and the movable mold 60. Consequently, in the conventional ink container manufacturing process, the gap may be created between the cover-side end of the inner layer and the movable mold. The resin used for the secondary molding may flow into the gap.

However, in the ink container 20 of the ink tank 1 according to the present embodiment, the flow-in preventing portion 26 is formed outside the cover member-side end of the side wall 25 of the ink container 20. The flow-in preventing portion 26 protrudes outward from the outermost position of the whole side wall of the inner wall 21 except for the cover-side end thereof. The flow-in preventing portion 26 is a member preventing the second resin 22-*a* from flowing toward the cover side during the step carried out during the manufacture of the ink container 20 of the ink tank 1 to form the layer located outside the inner layer 21, using the second resin 22-*a*. Thus, the present embodiment includes the flow-in preventing portion 26 projecting outward from the cover-side end of the side wall of the inner layer 21. This reduces the gap between the outer side surface of the flow-in preventing portion 26 and the second fixed mold 62. Consequently, the channel between the outer side surface of the flow-in preventing portion 26 and the second fixed mold 62 is formed to be narrower than the channel for the second resin 22-*a* between the inner layer 21 except for the flow-in preventing portion 26 and the second fixed mold 62. In FIG. 4B, reference character d denotes the width of the channel between the outer side surface of the flow-in preventing portion 26 and the second fixed mold 62. Reference character D denotes the width of the channel for the second resin 22-*a* between the inner layer 21 except for the flow-in preventing portion 26 and the second fixed mold 62.

FIG. 1B shows an enlarged sectional view of the flow-in preventing portion 26 wherein the entire tip of the cover member-side end of the side wall 25 of the ink container 20 according to the present embodiment is formed as the ink container-side coupling portion 23 so that the flow-in preventing portion 26 projects outward. The arrows in FIG. 1B show the directions of the shrinkage after the primary molding. The channel between the outer side surface of the flow-in preventing portion 26 and the second fixed mold 62 has a small width. Thus, during the secondary molding step, when the outer layer is formed outside the inner layer 21, the flow-in preventing portion 26 blocks the channel between the inner layer 21 and the second fixed mold 62. Consequently, the channel between outer side surface of the flow-in preventing portion 26 and the second fixed mold 62 has a large flow resistance to the second resin 22-*a*. When filled into the mold tool during the secondary molding, the second resin 22-*a* is prevented from flowing beyond the flow-in preventing portion 26 to the cover member side. This enables a reduction in the amount of second resin 22-*a* flowing into the gap 65 during the secondary molding. Thus, the second resin 22-*a* can be inhibited from being positioned in the portion of the ink container 20 where the resin may come into contact with the ink. This in turn inhibits resin components eluted from the second resin from flowing into the ink. Furthermore, the ink container 20 exhibits an excellent gas barrier property.

Furthermore, the resin 22-*a* is inhibited from flowing into the gap 65 between the inner layer 21 and the cover member-side end of the side wall 25 of the ink container 20. The flow of the second resin 22-*a* is thus stopped inside the gap and inhibited from being formed recesses and protrusions This prevents recesses and protrusions from being formed on the surface of the cover-side end of the side wall 25 of the ink container 20. The surface of the cover-side end is thus kept smooth. Consequently, an appropriate junction area is ensured for the junction between the side wall 25 of the ink container and the cover member. Therefore, a high bonding strength is maintained between the side wall and the cover member.

In the present embodiment, in particular, the shape of the flow-in preventing portion 26 allows the whole tip of the cover member-side end of the side wall 25 to be used as an area for the junction between the ink container 20 and the cover member 10. This allows a large coupling portion to be formed between the ink container 20 and the cover member 10. FIG. 1C is an enlarged sectional view of the coupling portion between the cover member and ink container coupled together. This ensures the increased strength of the coupling portion, thus stabilizing the shape of the ink tank and improving quality.

Second Embodiment

Now, a second embodiment in which the present invention is implemented will be described. Components of the second embodiments similar to corresponding ones of the first embodiment will not be described. Only differences from the first embodiment will be described.

FIGS. 6A to 6D are sectional views of an ink tank according to a second embodiment of the present invention. FIGS. 7A to 7D show the appearance of the ink tank according to the second embodiment. FIG. 6A is a sectional view taken along line VIA-VIA in FIG. 7C. FIG. 6B is a sectional view taken along line VIB-VIB in FIG. 6A. FIG. 6C is an enlarged sectional view of the cover member-side end of a side wall 25' of an ink container 20' of an ink tank 1' according to the present embodiment. FIG. 6D is an enlarged sectional view of a coupling portion between the ink container 20' and cover member 10' of the ink tank 1' according to the present embodiment and the cover member 10'; the container 20' and the cover member 10' are coupled together. FIG. 7A is a plan view of the ink tank 1' as viewed from above. FIG. 7B is a side view of the ink tank 1'. FIG. 7C is a plan view of the ink tank 1' as viewed from below. FIG. 7D is a front view of the ink tank 1'.

The ink tank 1' according to the present embodiment can be mounted in an ink jet printing apparatus. A prism 27 and a light guide portion 31 are provided on the bottom surface of a liquid housing chamber 2 in the ink tank 1'; the prism 27 allows the amount of remaining ink to be optically sensed, and the light guide portion 31 guides light.

The ink tank 1' shown in FIG. 6 has the cover member 10' and the ink container 20'. In the ink tank 1', the cover member 10' and the ink container 20' are coupled together to define the liquid housing chamber 2 in which ink is housed and an absorber housing chamber 3 in which an absorber is housed.

The ink container 20' is formed of a plurality of layers. Also in the present embodiment, an inner layer 21' having a surface contacting ink is formed of a first resin 21-*a*. An outer layer 22' provided outside the inner layer 21' is formed of a second resin 22-*a*. In the ink container 20', the prism 27 is provided on the bottom surface 24 of the liquid housing chamber 2 to allow the amount of ink remaining inside the liquid housing chamber 2 to be optically sensed. The part of the inner layer 21' with the prism 27 formed thereon is exposed to the exterior to enable provision of light to the exterior and reception of external light.

A substrate 50 is located in the ink tank 1 and has an information storage medium storing individual information on ink stored inside the ink tank 1' and a light emission portion 51. The ink tank 1' has the light guide portion 31 guiding light from the light emission portion 51 to the exterior. In the present embodiment, the light guide portion 31 is formed of the first resin 21-*a*.

Furthermore, the first embodiment includes the flow-in preventing portion 26 formed so as to project outward from the cover-side end of the side wall 25 of the ink container 20. In contrast, the present embodiment includes a flow-in preventing portion 26' formed so that a part of the cover member-side end of the side wall 25' of the ink container 20' projects further toward the cover member as shown in FIG. 6A. In the present embodiment, in particular, only the part of the side wall 25' positioned outside the cover member-side end thereof projects further toward the cover member side.

FIG. 6C is an enlarged sectional view showing the flow-in preventing portion 26' according to the present embodiment together with arrows indicating the direction and degree of shrinkage. As shown in FIG. 6C, the flow-in preventing portion 26' according to the present embodiment is shaped so as to project from the side wall 25' toward the cover member side. Thus, only a small gap is formed between the flow-in preventing portion 26', formed at the cover member-side end of the side wall 25', and the mold used to form the side wall 25. This reduces the amount of flow-in second resin 22-*a* during secondary molding. Furthermore, the shape of the flow-in preventing portion 26' according to the present embodiment is such that the outer layer 22 covers the inner layer 21' up to the tip of the cover-side end of the side wall. Thus, in the present embodiment, the outer layer 22' covers the entire ink container 20', allowing desinability and the usage of the recycled resin to be improved. The shape of the flow-in preventing portion 26' according to the present embodiment is such that the ink container 20' couples to the cover member 10' at portions other than the flow-in preventing portion 26' of the cover member-side end of the side wall 25' as well as the outer layer 22'. Thus, the coupling portion, that is, an ink container-side coupling portion 23, tends to have a small area. However, the portion forming the flow-in preventing portion 26' and the outer layer 22' is actually thinner than the area of the ink container-side coupling portion 23. Thus, an actual fusion step is not affected.

A process of manufacturing the ink container 20' according to the second embodiment will be described with reference to FIGS. 8A to 8D.

Figure 8A:
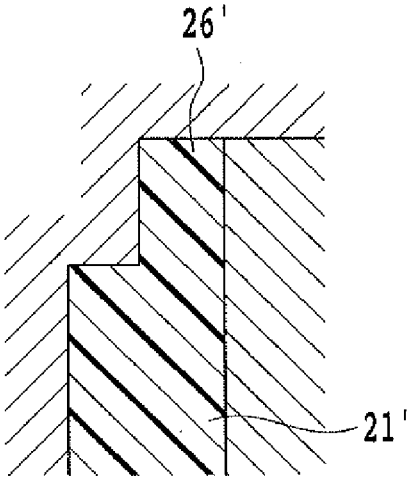
Figure 8B:
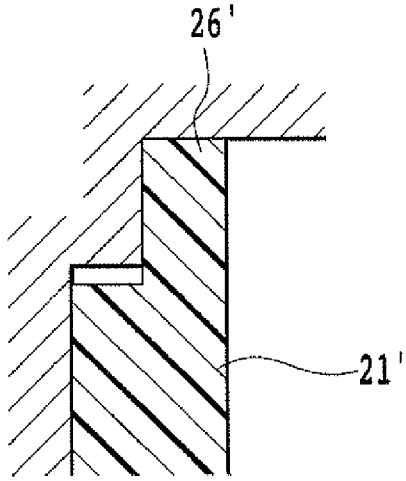
Figure 8C:
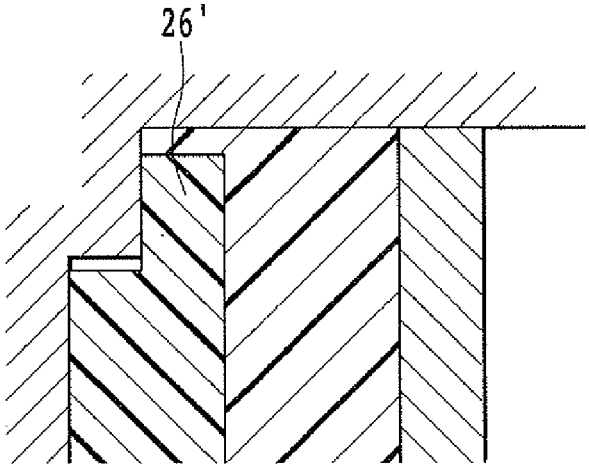
Figure 8D:
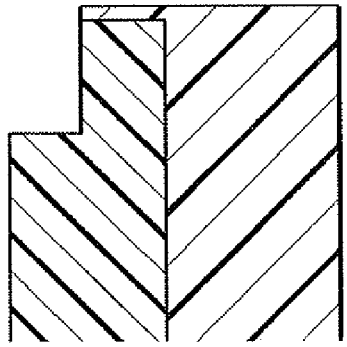

As shown in FIG. 8A, first, to form an inner layer 21', the first resin 21-*a* is filled between a movable mold 60' and a first fixed mold 61'. Primary molding is thus performed. Thereafter, as shown in FIG. 8B, with the inner layer 21' held, the movable mold moves from a position corresponding to the first fixed mold 61' to a position corresponding to a second fixed mold 62' (FIG. 8C). At this time, the inner layer 21' formed by the primary molding is cooled and shrunk. Thereafter, the second resin 22-*a* is filled between the inner layer 21' and the second fixed mold 62', as shown in FIG. 8C. Secondary molding is thus performed. Then, as shown in FIG. 8D, the ink container according to the present embodiment is taken out of the mold tool.

Here, in the shrinkage between the primary molding and the secondary molding, the amount of shrinkage is relatively large in a direction from the cover member-side of the side wall 25' to the bottom wall 24 but is relatively small in a direction from the outside to inside of the ink container 20'. Thus, during the secondary molding, the second resin 22-*a* can flow beyond the flow-in preventing portion 26' toward the cover member side but has difficulty flowing between the inner side surface of the flow-in preventing portion 26' and the movable mold 61 toward the bottom surface side. Consequently, during the secondary molding, the second resin 22-*a* is prevented from flowing beyond the flow-in preventing portion 26' toward the inside of the ink container 20'.

The shape of the cover member-side end of the side wall of the ink container is not limited to the first and second embodiments. The cover member-side end of the side wall of the ink container may have any other shape provided that the flow-in preventing portion is formed at the cover member-side end of the side wall of the ink container so as to project from the cover member-side end so that the channel for the resin is narrowed when a layer is formed outside the innermost layer. The shape of the cover member-side end of the side wall may be, for example, as shown in FIGS. 9A and 9B.

A flow-in preventing portion 26" shown in FIG. 9A is formed so as to extend further toward the cover member side from an inner part of the cover member-side end of a side wall 25" of an inner layer 21" of the ink container. A process of manufacturing an ink container shaped as described above will be described with reference to FIGS. 10A to 10D.

Figure 10A:
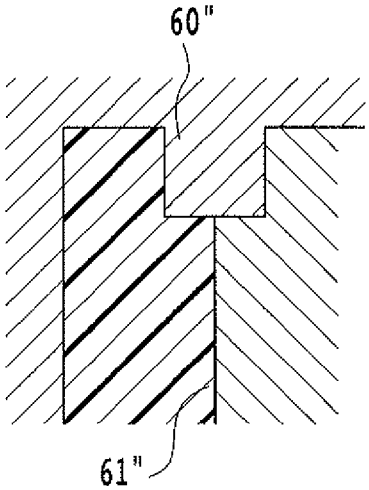
Figure 10B:
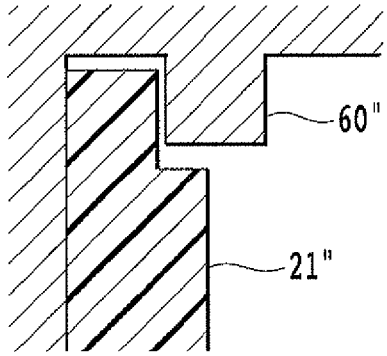
Figure 10C:
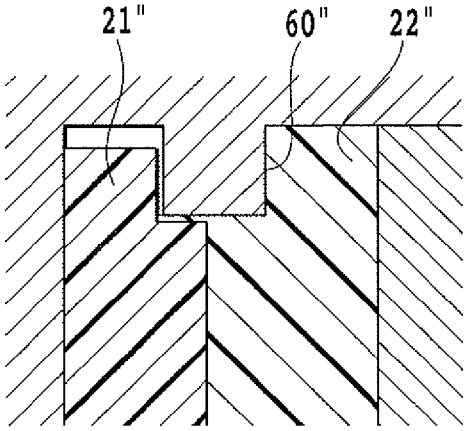
Figure 10D:
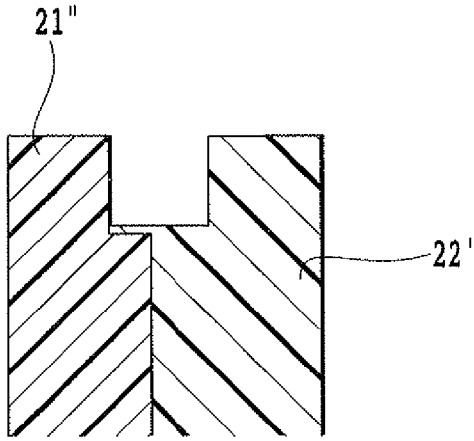

As shown in FIG. 10A, firsts the first resin 21-*a* is filled between a movable mold 60" and a first fixed mold 61". Thereafter, as shown in FIG. 10B, with the inner layer 21" held, the movable mold moves from a position corresponding to the first fixed mold 61" to a position corresponding to a second fixed mold 62". At this time, the inner layer 21" formed by the primary molding is cooled and shrunk. Thereafter, as shown in FIG. 10C, the second resin 22-*a* is filled between the inner layer 21" and the second fixed mold 62". Secondary molding is thus performed. Then, as shown in FIG. 10D, the ink container according to the present embodiment is taken out of the mold tool.

Here, between the primary molding and the secondary molding, when the movable mold 60" moves from the position corresponding to the first fixed mold 61" to the position corresponding to the second fixed mold 62", the inner layer 21" shrinks. Here, the side wall of the ink container shrinks in a direction from the cover member side toward the bottom surface, a gap is formed between the flow-in preventing portion 26" and the movable mold 60".

However, in the present embodiment, the flow-in preventing portion 26" is formed so as to extend further toward the cover member side from the inner part of the cover member-side end of the inner layer 21". The flow-in preventing portion 26" is relatively thin in a direction from the inside toward outside of the ink container and thus shrinks relatively insignificantly in this direction. This allows a reduction in the width of the gap between the outer part of the flow-in preventing portion 26" and the movable mold 60". Thus, during the secondary molding, the second resin 22-*a* can be inhibited from flowing beyond the gap between the outer part of the flow-in preventing portion 26" and the movable mold 60" into the gap between the cover member-side end of the flow-in preventing portion 26" and the movable mold 60". Furthermore, in the present embodiment, an outer layer 22" covers the entire ink container, enabling desinability and the usage of the recycled resin to be improved.

FIG. 9B is an enlarged sectional view of a coupling area in which the cover member and the cover member-side end of the side wall of the ink container according to the present embodiment are coupled together.

Alternatively, the shape of the cover member-side end of the side wall of the ink container may be as shown in FIGS. 11A and 11B. In FIG. 11A, a flow-in preventing portion 26''' is formed so as to extend outward from the outer part of the cover member-side end of a sidewall 25''' of the ink container and toward the cover member side. A method of manufacturing the ink container shaped as described above will be described with reference to FIGS. 12A to 12D.

Figure 12A:
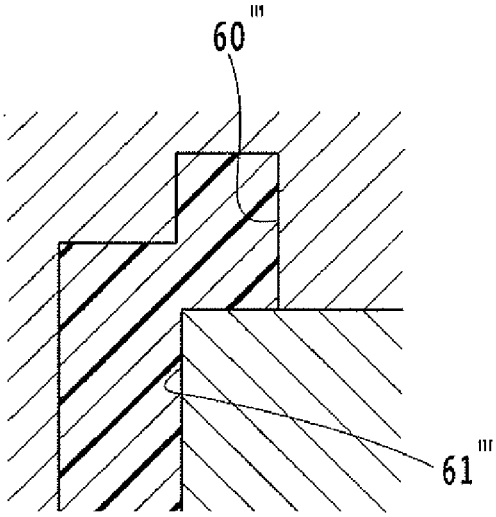
Figure 12B:
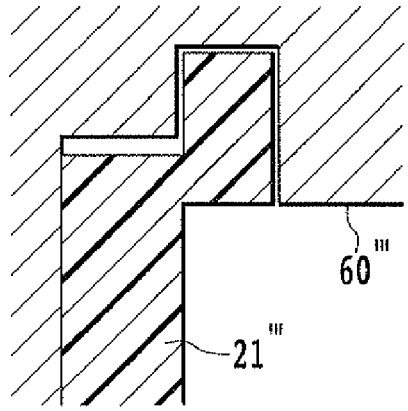
Figure 12C:
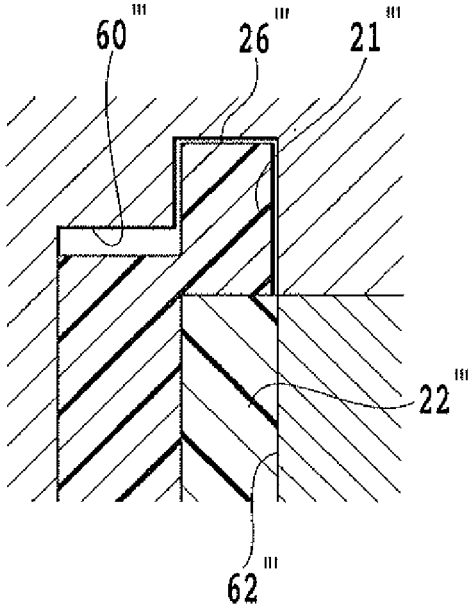
Figure 12D:
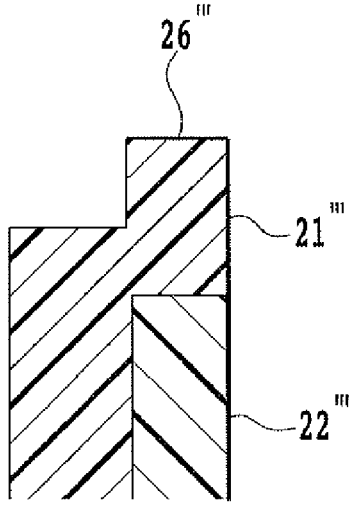

As shown in FIG. 12A, first, the first resin 21-*a* is filled between a movable mold 60''' and a first fixed mold 61'''. Thereafter, as shown in FIG. 12B, with the inner layer 21''' held, the movable mold moves from a position corresponding to the first fixed mold 61''' to a position corresponding to a second fixed mold 62'''. At this time, an inner layer 21''' formed by the primary molding is cooled and shrunk. Thereafter, as shown in FIG. 12C, the second resin 22-*a* is filled between the inner layer 21''' and the second fixed mold 62'''. Secondary molding is thus performed. Then, as shown in FIG. 12D, the ink container according to the present embodiment is taken out of the mold tool.

Here, between the primary molding and the secondary molding, when the movable mold 60''' moves from the position corresponding to the first fixed mold 61''' to the position corresponding to the second fixed mold 62''', the inner layer 21''' shrinks. At this time, the side wall of the ink container shrinks in a direction from the cover member side toward the bottom surface, a gap is formed between the cover member-side end of the side wall of the ink container and the movable mold 60'''.

However, in the present embodiment, the flow-in preventing portion 26''' is formed so as to extend outward from the outer part of the cover member-side end of the inner layer 21''' and toward the cover member side. The flow-in preventing portion 26''' is relatively thin in a direction from the inside toward outside of the ink container and thus shrinks relatively insignificantly in this direction. This narrows the channel between the flow-in preventing portion 26''' and the movable mold 60'''. Thus, the second resin **22-*a* is inhibited from flowing around the flow-in preventing portion 26''' to reach the gap between the cover member-side end of the side wall 25''' and the movable mold 60'''**.

Furthermore, if the shape of the flow-in preventing portion 26''' according to the present embodiment is adopted, the narrow channel between the flow-in preventing portion 26''' and the movable mold 60''' is formed to be long and curved compared to that in the above-described embodiment. This further increases the resistance of the channel to further inhibit the second resin **22-*a* from reaching the gap between the cover member-side end of the side wall 25''' and the movable mold 60'''** during the secondary molding.

FIG. 11B is an enlarged sectional view of a coupling area in which the cover member and the cover member-side end of the side wall of the ink container according to the present embodiment are coupled together.

The configuration of the ink tank may be different from that described in the above described embodiment.

For example, FIGS. 13 and 14A to 14D show the configuration of an ink tank that can be mounted in an ink jet printing apparatus and in which the prism 27 is provided on the bottom surface of the liquid housing chamber 2 to allow the amount of ink remaining inside the liquid housing chamber 2 to be optically sensed.

FIGS. 15 and 16A to 16D show the configuration of another ink tank which can be mounted in an ink jet printing apparatus and which has the light guide portion 31 guiding light.

FIGS. 17 and 18A to 18D show the configuration of another ink tank which can be mounted in an ink jet printing apparatus; the ink tank corresponds to the one shown in FIGS. 6A to 6D and not including the prism 27 or the light guide portion 31.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-198851, filed Jul. 31, 2008, which is hereby incorporated by reference herein in its entirety.

What is claimed is:

1. An ink container housing ink, the ink container comprising:

a cover member; and a container member having an inner layer formed of a first resin and contacting with the housed ink and an outer layer forming a layer arranged at an outermost portion of the container member and being formed of a second resin different from the first resin;

wherein the inner layer is configured such that a part of an end thereof on a cover member-side projects toward an outer layer-side.

2. The ink container according claim 1, wherein a projecting portion of the inner layer which projects toward the outer layer-side is formed so as to project outwardly more than an outermost position of a portion of a side wall of the inner layer.

3. The ink container according claim 1, wherein the first resin is more transparent than the second resin, wherein a prism is provided to sense amount of liquid remaining inside the container member, wherein the prism is formed of the first resin, and wherein a portion of the prism corresponding to a portion of the prism contacting with the liquid is exposed from the container member.

4. The ink container according claim 1, wherein the first resin is more transparent than the second resin, wherein the ink container further comprises an information storing medium storing individual information on the liquid accommodated inside the container member as well as a light emitting portion, wherein a light guide portion guiding light from the light emitting portion to an exterior of the container member, and wherein the light guide portion is formed of the first resin.

5. The ink container according claim 1, wherein the second resin is a reutilized material containing recycled material.

6. The ink container according claim 1, wherein the first resin is a non-reutilized, virgin resin.

7. The ink container according to claim 1, wherein a projecting portion of the inner layer which projects to the outer side layer-side is formed so as to cover an end portion of the outer layer in the cover member-side.

8. An ink container housing ink, the ink container comprising:

a cover member; and a container member having multiple layers including an innermost layer in contact with the ink and an outermost layer, the innermost layer being formed of a first resin and the outermost layer forming being formed of a second resin different from the first resin;

wherein in a cross section of the container member the innermost layer and the outermost layer are both U-shaped with respective end portions, and wherein the end portions of the innermost layer extend outwardly overtop of the end portions of the outermost layer.

* * * * *